US010155650B2

(12) United States Patent
Petermann

(10) Patent No.: US 10,155,650 B2
(45) Date of Patent: Dec. 18, 2018

(54) FLUID DISPENSING SYSTEM

(71) Applicant: Carlo Petermann, Buffalo, NY (US)

(72) Inventor: Carlo Petermann, Buffalo, NY (US)

(73) Assignee: Integrated Dispensing Systems, LLC, Oakdale, PA (US)

( * ) Notice: Subject to any disclaimer, the term of this patent is extended or adjusted under 35 U.S.C. 154(b) by 0 days.

(21) Appl. No.: 15/095,466

(22) Filed: Apr. 11, 2016

(65) Prior Publication Data

US 2016/0297665 A1 Oct. 13, 2016

Related U.S. Application Data

(60) Provisional application No. 62/145,860, filed on Apr. 10, 2015, provisional application No. 62/244,896, filed on Oct. 22, 2015.

(51) Int. Cl.
*B67D 1/08* (2006.01)
*B67D 1/12* (2006.01)
(Continued)

(52) U.S. Cl.
CPC ..... *B67D 1/0888* (2013.01); *B67D 1/1247* (2013.01); *B67D 1/1272* (2013.01); *B67D 1/1422* (2013.01); *B67D 1/0006* (2013.01); *B67D 1/0406* (2013.01); *B67D 1/0437* (2013.01); *B67D 1/0864* (2013.01); *B67D 1/0867* (2013.01); *B67D 1/0884* (2013.01); *B67D 1/1202* (2013.01); *B67D 1/1234* (2013.01); *B67D 1/1252* (2013.01); *B67D 1/1466* (2013.01); *B67D 2001/0487* (2013.01);
(Continued)

(58) Field of Classification Search
CPC ..... B67D 1/0888; B67D 1/1247
USPC ..... 222/54
See application file for complete search history.

(56) References Cited

U.S. PATENT DOCUMENTS 3,868,979 A * 3/1975 Leining ..... B65B 37/20 141/159
3,878,970 A * 4/1975 Nezworski ..... B67D 1/1243 222/61
5,203,474 A * 4/1993 Haynes ..... B67D 1/0044 222/129.1
(Continued)

OTHER PUBLICATIONS

International Search Report and Written Opinion of International Application No. PCT/US2016/026889, filed on Apr. 11, 2016, pp. 1-11, dated Jul. 1, 2016.

*Primary Examiner* — Jeremy Carroll
(74) *Attorney, Agent, or Firm* — Cohen & Grigsby, PC

(57) ABSTRACT

A liquid dispenser comprise a nozzle comprising an inlet in fluid communication with an outlet to form a flow path, a thermistor in fluid communication with the inlet, an actuator rod comprising a gasket rod tip viton, at least one centering pin to center the actuator rod in at least a portion of the flow path, a flowmeter in fluid communication with the inlet, a double acting pneumatic cylinder comprising a first pneumatic inlet and a second pneumatic inlet operatively connected to the actuator rod, and a switch lever operatively coupled to a micro switch, wherein the nozzle opens when gas enters the first pneumatic inlet when the switch lever is activated by pressing on the micro switch and closes when gas enters the second pneumatic inlet when the switch lever is deactivated. Portable and non-portable liquid dispensing systems comprising the liquid dispenser are also described.

20 Claims, 18 Drawing Sheets

(51) Int. Cl.
*B67D 1/14* (2006.01)
*B67D 1/04* (2006.01)
*B67D 1/00* (2006.01)

(52) U.S. Cl.
CPC ..... *B67D 2001/1488* (2013.01); *B67D 2210/00091* (2013.01)

(56) References Cited

U.S. PATENT DOCUMENTS

| | | | | |
|---|---|---|---|---|
| 6,230,767 | B1 * | 5/2001 | Nelson | B67C 3/2608 141/264 |
| 6,669,051 | B1 * | 12/2003 | Phallen | B67C 3/281 222/1 |
| 6,695,168 | B2 * | 2/2004 | Pinedjian | B67D 1/0006 222/54 |
| 2001/0010318 | A1 | 8/2001 | Saveliev et al. | |
| 2005/0194399 | A1 * | 9/2005 | Proctor | B67D 1/0881 222/1 |
| 2006/0032869 | A1 * | 2/2006 | Younkle | B67D 1/0865 222/399 |
| 2008/0141702 | A1 * | 6/2008 | Gagliano | B67D 1/0007 62/389 |
| 2010/0282334 | A1 * | 11/2010 | Hartmann | B67D 1/1247 137/170.2 |
| 2011/0011108 | A1 | 1/2011 | Chadwell et al. | |
| 2011/0289947 | A1 * | 12/2011 | Chadwell | B67D 1/0862 62/115 |
| 2013/0096715 | A1 * | 4/2013 | Chung | G06Q 20/32 700/233 |
| 2015/0321896 | A1 * | 11/2015 | Kobayashi | F25D 31/003 222/54 |

* cited by examiner

KEYPAD

| | | | |
|---|---|---|---|
| | SIZE 1 + LED GREEN | | TOP OFF (MANUAL) |
| | SIZE 2 + LED GREEN | | CHANGE + EMPTY LED (RED) |
| | ALARM LED (RED) | | STOP |

FIG. 8.1
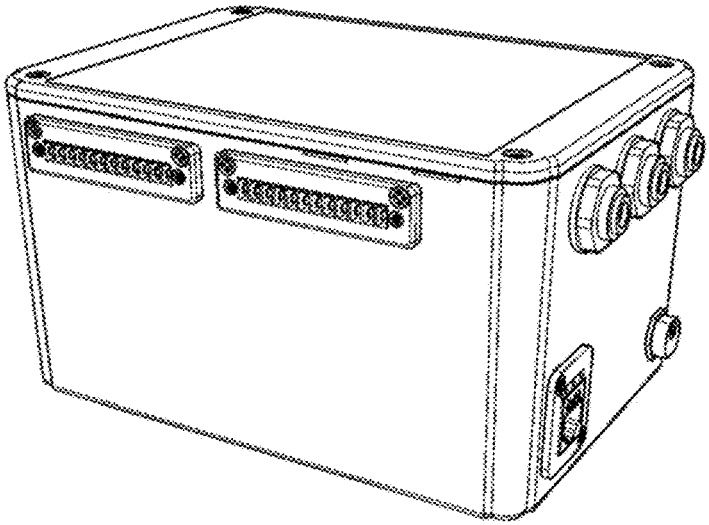
FIG. 8.2
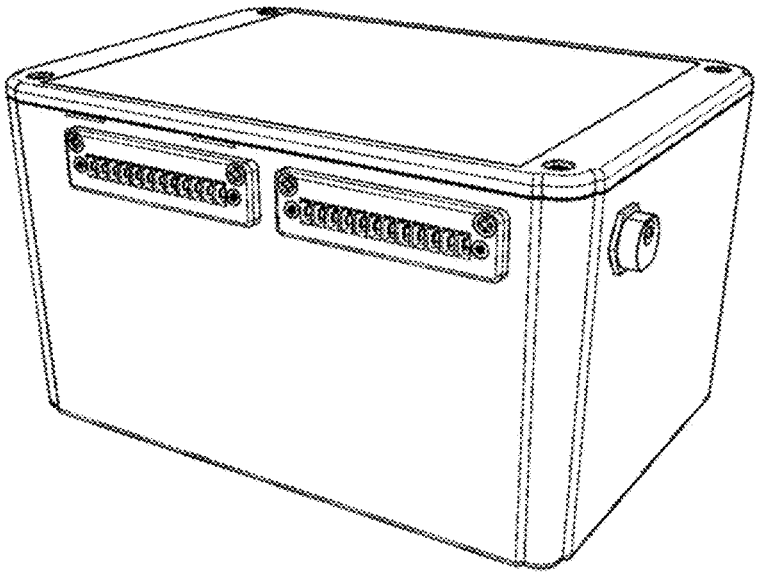

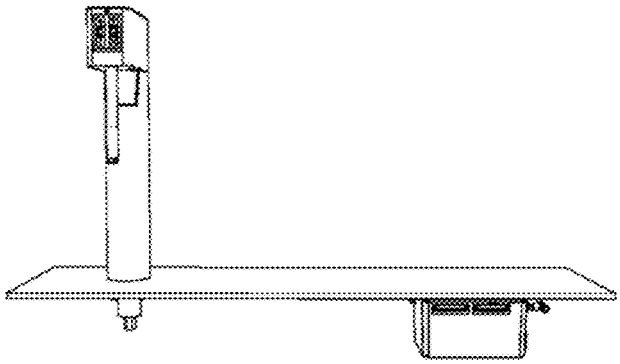
FIG. 9.1
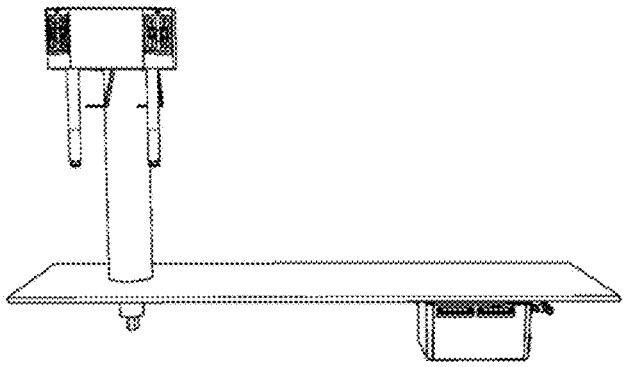
FIG. 9.2
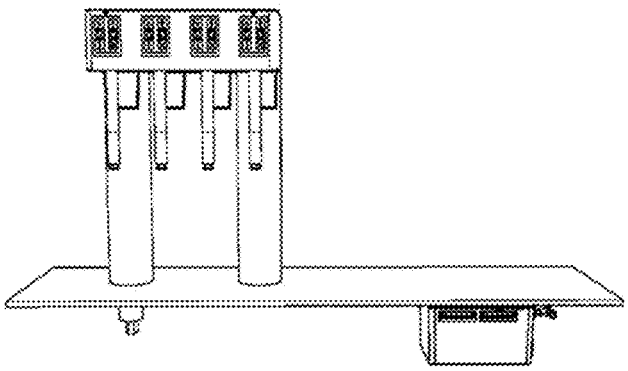
FIG. 9.3

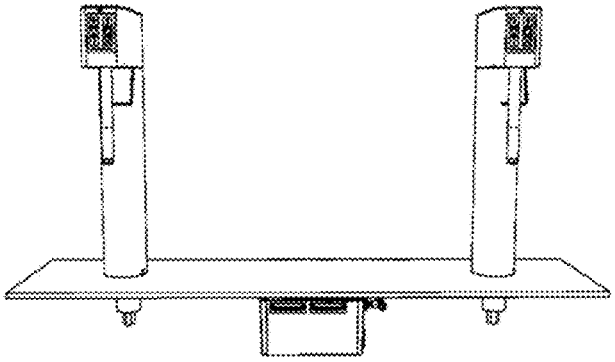
FIG. 9.4
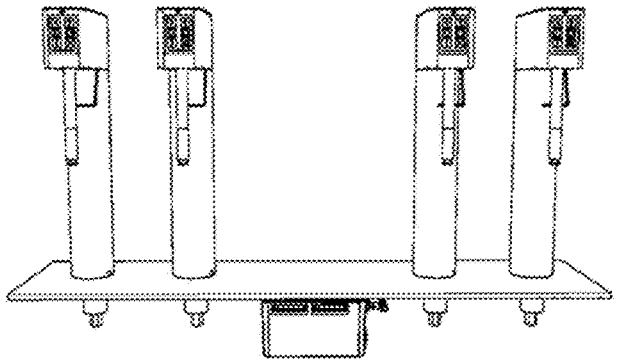
FIG. 9.5
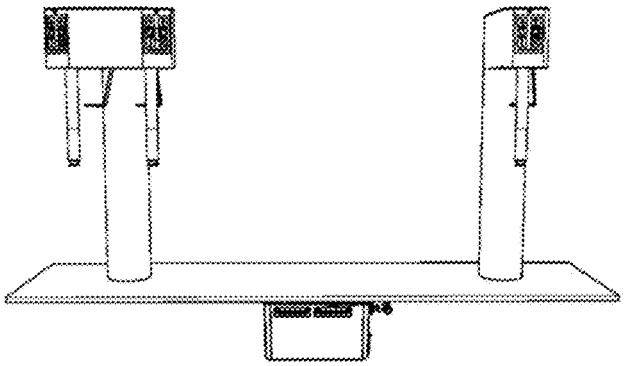
FIG. 9.6
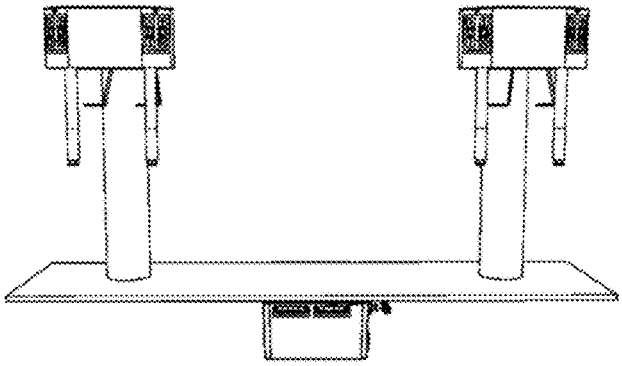
FIG. 9.7

FIG. 10.1

USER LOGIN

| | |
|---|---|
| Username | admin |
| Password | •••••••• |

LOGIN

FIG. 10.2

CHANGE USER PASSWORD

| | |
|---|---|
| Type new Password | |
| Re-type new Password | |
| Type old password | |

SAVE CHANGES

FIG. 10.3

UNITS OF MEASURE

Currently the units of measure are Metric

| | |
|---|---|
| Metric Units | ◉ |
| Imperial Units/UK | ○ |
| U.S. Units | ○ |

SUBMIT

FIG. 10.4

OPENING HOURS HH:MM

| | | |
|---|---|---|
| Monday | Open | 00:00 |
| | Close | 24:00 |
| Tuesday | Open | 00:00 |
| | Close | 24:00 |
| Wednesday | Open | 00:00 |
| | Close | 24:00 |
| Thursday | Open | 00:00 |
| | Close | 24:00 |
| Friday | Open | 00:00 |
| | Close | 24:00 |
| Saturday | Open | 00:00 |
| | Close | 24:00 |
| Sunday | Open | 00:00 |
| | Close | 24:00 |
| Moday | Open | 00:00 |
| | Close | 24:00 |

FIG. 10.5

YOUR BEERS ON TAP

| Nozzle | Beers | Keg Type | Keg size (lt) | Beer Pr.1 | Beer Pr.2 |
|---|---|---|---|---|---|
| 1 | Beer1 | Special size | 15.00 | ◉ BP1 | ○ BP2 |
| 2 | Beer2 | Euro-Keg 30Lt | 30.00 | ◉ BP1 | ○ BP2 |
| 3 | Beer3 | Euro-Keg 30Lt | 30.00 | ◉ BP1 | ○ BP2 |
| 4 | Beer4 | Euro-Keg 30Lt | 30.00 | ◉ BP1 | ○ BP2 |

SUBMIT

FIG. 10.6

CUP SIZES (lt)

| | | |
|---|---|---|
| Nozzle 1 | Size 1 | 0.40 |
| | Size 2 | 0.42 |
| Nozzle 2 | Size 1 | 0.25 |
| | Size 2 | 0.38 |
| Nozzle 3 | Size 1 | 0.25 |
| | Size 2 | 0.38 |
| Nozzle 4 | Size 1 | 0.25 |
| | Size 2 | 0.38 |

SUBMIT

FIG. 10.7

MINIMUM TOWER PRESSURE

| | |
|---|---|
| Pneumatic pressure (bar) | 4.0 |

SUBMIT

FIG. 10.8

MINIMUM BEER PRESSURE

| | |
|---|---|
| Minimum beer pressure1 (bar) | 0.0 |
| Minimum beer pressure2 (bar) | 0.0 |

SUBMIT

FIG. 10.9

ENABLE / DISABLE

Enable (on) or Disable (off) dispensing

Currently the unit is ON

| | |
|---|---|
| ◉ ON | ○ OFF |

SUBMIT

FIG. 10.10

SET TIME AND DATE

The current time is Sun Sep 28 17:50:57 2014

| | |
|---|---|
| Date: | |
| Time: | |

SUBMIT

FIG. 10.11

DATA QUERY

Please input the date range and select beer type.
For the date utilize the following format:
(dd-mm-yyyy)

From:

To:

SELECT BEER

Select All

VIEW DATA

DOWNLOAD EXCEL FILE

FIG. 10.12

MAX BEER TEMPERATURE

| | |
|---|---|
| Nozzle1 (°C) | 5.0 |
| Nozzle2 (°C) | 5.0 |
| Nozzle3 (°C) | 5.0 |
| Nozzle4 (°C) | 5.0 |

SUBMIT

FIG. 10.13

WLAN NETWORKS AVAILABLE

- lucasalexhome
- USR5405
- belkin.3180

Password

CONNECT

FIG. 11

THIS IS YOUR DATA

May 15th 2014

| Beer | Time | Q.ty (lt) | Flowrate (lt/min) | Daily Q.ty (lt) | Keg Yield% | Temp (°C) | Tower Pr. (bar) | Beer Pr. (bar) | Notice | Warning |
|---|---|---|---|---|---|---|---|---|---|---|
| Heineken | 10:38:08 | 0.33 | 6.40 | 0.33 | 2.18 | 6.8 | 7.6 | 2.9 | | |
| Heineken | 10:39:22 | 0.43 | 6.68 | 0.76 | 5.03 | 3.4 | 7.4 | 2.8 | | |
| Heineken | 10:45:38 | 0.33 | 6.57 | 1.09 | 7.21 | 3.8 | 7.4 | 2.8 | | |
| Heineken | 10:46:28 | 0.33 | 6.50 | 1.42 | 9.39 | 3.2 | 7.4 | 2.8 | | |
| Heineken | 10:47:43 | 0.33 | 6.46 | 1.75 | 11.57 | 3.4 | 7.4 | 2.8 | | |
| Heineken | 10:49:02 | 0.33 | 6.48 | 2.08 | 13.75 | 3.4 | 7.4 | 2.7 | | |
| Heineken | 10:52:32 | 0.33 | 6.33 | 2.41 | 15.94 | 4.7 | 3.6 | 2.8 | | |
| Heineken | 10:55:01 | 0.33 | 6.43 | 2.74 | 18.12 | 4.2 | 3.2 | 2.8 | | |
| Heineken | 10:55:52 | 0.33 | 6.45 | 3.07 | 20.30 | 3.5 | 2.5 | 2.7 | | |
| Heineken | 11:01:48 | 1.15 | 6.84 | 4.22 | 27.88 | 2.9 | 2.3 | 2.6 | | |
| Heineken | 11:01:49 | 0.01 | 1.83 | 4.23 | 28.06 | | 2.3 | 2.7 | Top off | |
| Heineken | 11:01:51 | 0.01 | 1.38 | 4.24 | 28.11 | | 2.3 | 2.6 | Top off | |
| Heineken | 11:01:58 | 0.70 | 6.01 | 4.94 | 32.75 | 2.1 | 2.1 | 2.8 | | |
| Heineken | 11:02:45 | 1.28 | 6.18 | 6.14 | 40.73 | 2.8 | 2.1 | 2.6 | | |
| Heineken | 11:03:14 | 0.59 | 6.06 | 6.73 | 44.70 | 3.1 | 2.1 | 2.8 | | |
| Heineken | 11:07:53 | 0.33 | 6.01 | 7.06 | 46.88 | 5.3 | 2.1 | 2.8 | | |

FIG. 14

LIVE WARNINGS

DATE

| Time | Nameserver | Beer | Warning | Value |
|---|---|---|---|---|
| 16:38 | SECTION 102a | BUD LIGHT | Low Preumatic pressure | 90 psi |
| 16:40 | SECTION 204b | COORS LIGHT | High Beer Temperature | 44 F |
| 17:00 | SECTION 300c | HEINEKEN | Empty Keg | 90 % |

FLUID DISPENSING SYSTEM

CROSS REFERENCES TO RELATED APPLICATIONS

This application claims the benefit of U.S. Provisional Application No. 62/145,860, filed Apr. 10, 2015, and U.S. Provisional Application No. 62/244,896, filed Oct. 22, 2015, each of which is incorporated by reference herein in its entirety.

BACKGROUND

The present disclosure relates to a fluid dispensing system for reducing the amount of foam created when dispensing a carbonated liquid into a container.

Carbonated beverages, such as draft or draught beer, are commonly stored in large volume containers and then dispensed to glasses or cups for consumption. For example, beer may be served from a keg rather than from a bottle or can. Beer is often stored under pressure in a large volume (e.g., 50 L) metal keg. A typical keg may have two openings in the center of its top. One opening may allow the beer to flow out of the keg and the other opening may allow gas to be introduced into the keg. Pressure in the keg then drives the beer to the dispensing tap. Conventional beer systems dispense at a flow rate between 2.5 to 3.8 L/min (1 gallon/min) depending on the consumer market and type of beer.

Carbonated beverages, such as beer and fountain drinks, may create foam when dispensed from a pressurized system into a container. This foam generates waste of the beverage. For example, it is estimated that at least 15 to 20% of beer is wasted when dispensed from a keg. Conventional systems configured to increase the keg yield by reducing waste may suffer from one or more of the following limitations:

- some dispense systems may fill the glass or cup from a hole in the bottom utilizing a closing valve magnet, which unfortunately means standard type glasses/cups cannot be utilized, and introducing a foreign object like the magnet to the beer is generally not considered hygienically sound;
- some dispense systems may provide a full retrofit system to existing dispense systems to monitor pouring parameters and present data on consumption, but provide no aid in proper pouring to reduce waste;
- some dispense systems may use outdated technology to interface to the dispensing unit to change pouring parameters or retrieve any data on consumption;
- some dispense systems may lack effective flow rates for beers having low carbon dioxide and added nitrogen gas, such as, for example, Stout type beers; and
- some dispense systems, such as a compact remote systems, comprising a conventional foam on beer ("FOB") detector installed at room temperature, and placed in a cooler or chiller may contaminate the system, such as, for example, promoting bacterial growth.

Accordingly, fluid dispensing systems that reduce foaming when dispensing a fluid are desirable.

BRIEF DESCRIPTION OF THE DRAWINGS

The embodiments described herein may be better understood by reference to the accompanying figures, in which:

FIGS. 8.1 and 8.2 illustrate examples of a control box of the liquid dispenser system;

FIGS. 9.1 to 9.7 illustrate examples of the liquid dispenser system;

FIGS. 10.1 to 10.13 illustrate examples of a user interface of the liquid dispenser system;

FIG. 11 illustrates an example of an output report of dispensing data;

FIG. 14 illustrates an example of a user interface of the central management server.

DETAILED DESCRIPTION

All numerical quantities stated herein are approximate, unless indicated otherwise, and are to be understood as being prefaced and modified in all instances by the term "about". The numerical quantities disclosed herein are to be understood as not being strictly limited to the exact numerical values recited. Instead, unless indicated otherwise, each numerical value included in this disclosure is intended to mean both the recited value and a functionally equivalent range surrounding that value.

All numerical ranges recited herein include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value equal to or less than 10.

As generally used herein, the articles "one", "a", "an", and "the" include "at least one" or "one or more" of what is claimed or described, unless indicated otherwise. For example, "a component" means one or more components, and thus, possibly, more than one component is contemplated and may be employed or used in an implementation of the described embodiments.

As generally used herein, the terms "include", "includes", and "including" are meant to be non-limiting.

As generally used herein, the terms "have", "has", and "having" are meant to be non-limiting.

A fluid dispensing system and method of using the same may be as substantially described in the specification and accompanying drawings. The fluid dispensing system may comprise a portable fluid dispensing system as substantially described in the specification and accompanying drawings. The fluid dispensing system may comprise a fluid dispenser as substantially described in the specification and accompanying drawings. The fluid dispenser may comprise a creamy fluid dispenser as substantially described in the specification and accompanying drawings. The fluid dispensing system may comprise a foam on fluid detector as substantially described in the specification and accompanying drawings. The fluid dispensing system may comprise a user interface as substantially described in the specification and accompanying drawings.

Figure 1:
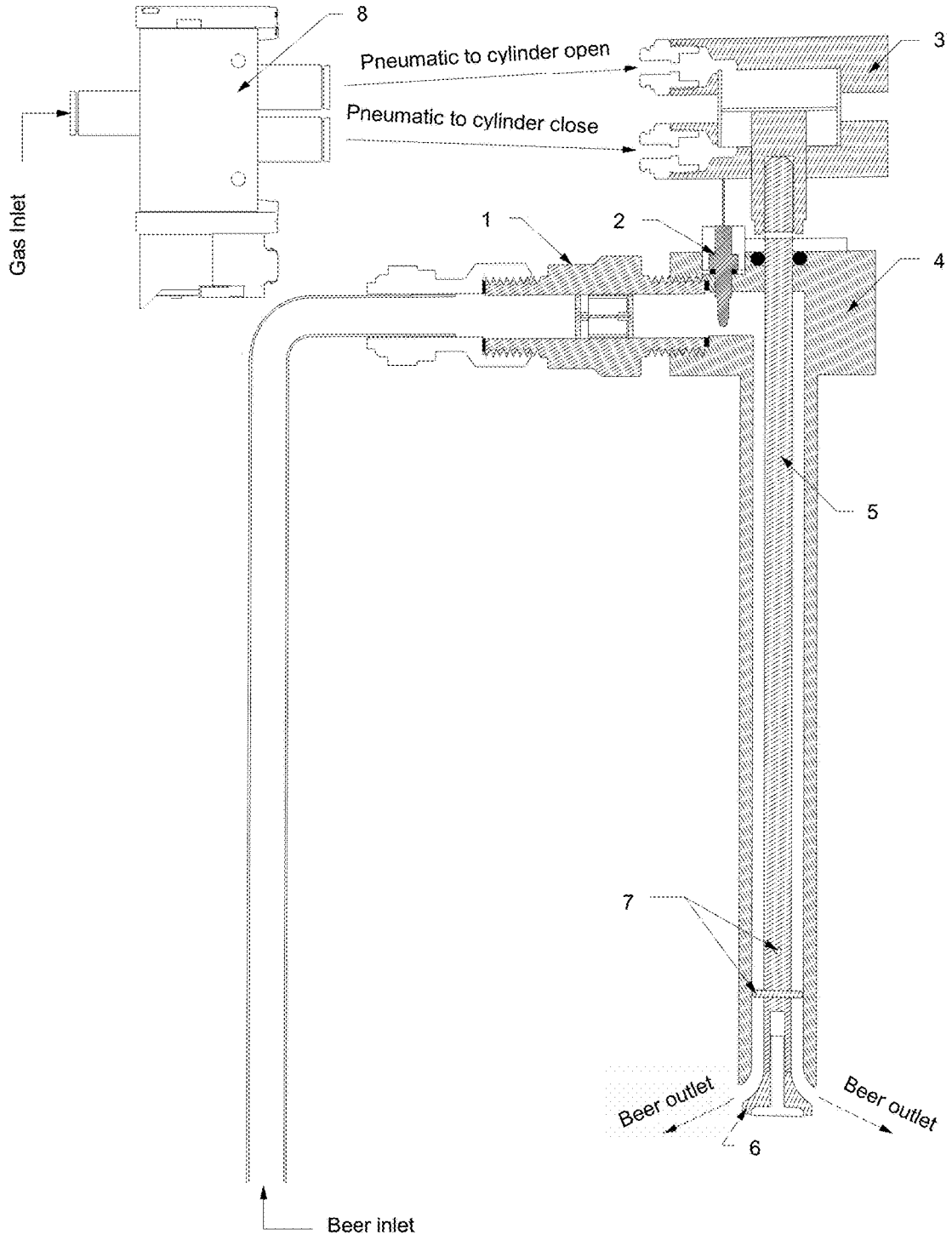
FIG. 1 illustrates an example of a liquid dispenser.

Referring to FIG. 1, a fluid dispenser may generally comprise a nozzle (4) comprising an inlet in fluid communication with an outlet to form a flow path; a thermistor (2) proximate to the inlet; an actuator rod (5) comprising a gasket rod tip viton (6); at least one centering pin (7) to center the actuator rod (5) in at least a portion of the flow path at the first outlet; and a double acting pneumatic cylinder (3) comprising a first pneumatic inlet and a second pneumatic inlet; wherein the nozzle (4) and/or actuator rod (5) opens to dispense fluid when gas enters the first pneumatic inlet of the cylinder (3) and closes when gas enters the second pneumatic inlet of the cylinder (3). The fluid dispenser may comprise a flowmeter (not shown) in fluid communication with the nozzle's inlet. The fluid may comprise a liquid, such as beer, for example.

Figure 4:
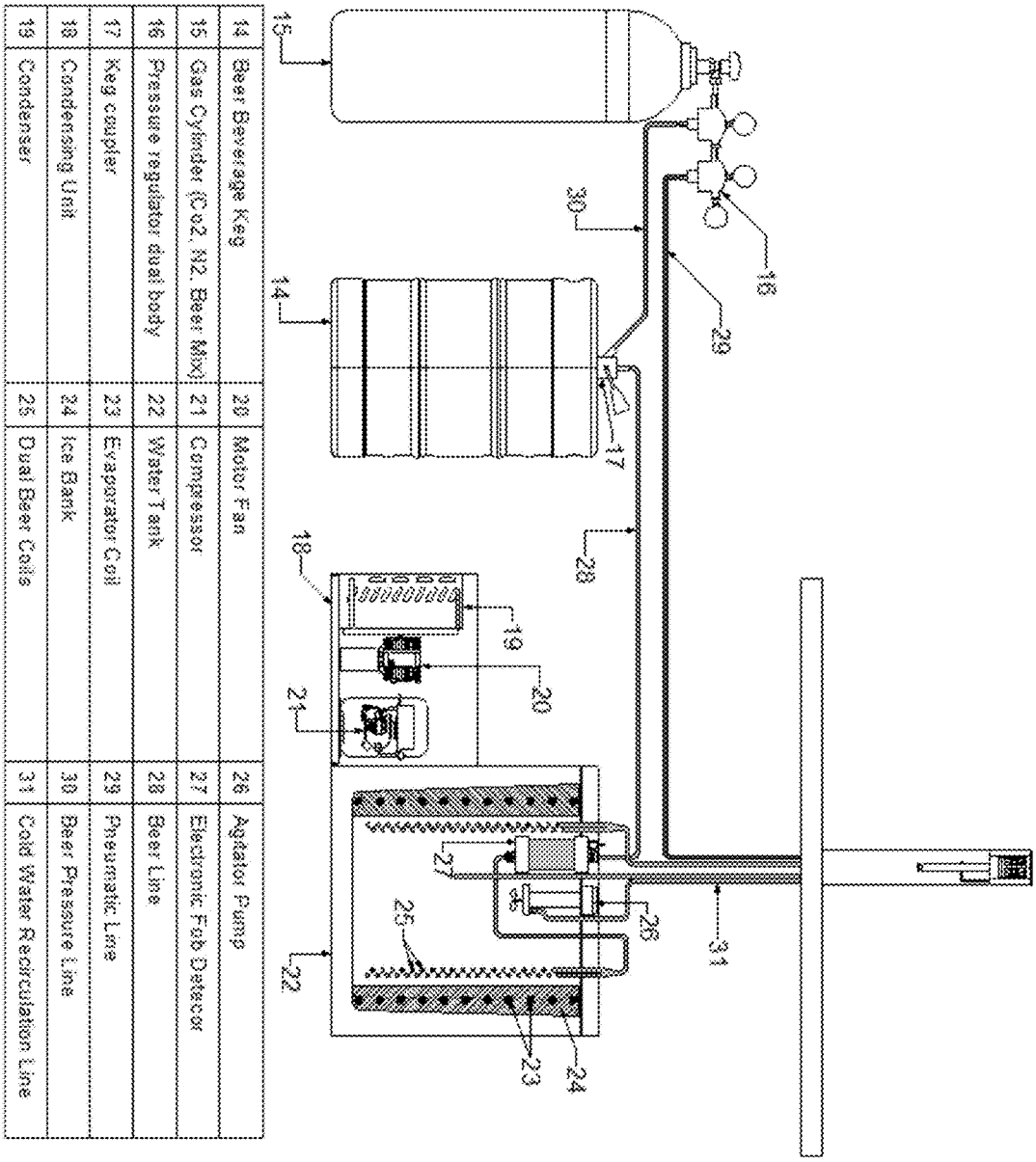
FIG. 4. illustrates an example of a liquid dispense system.
Figure 5:
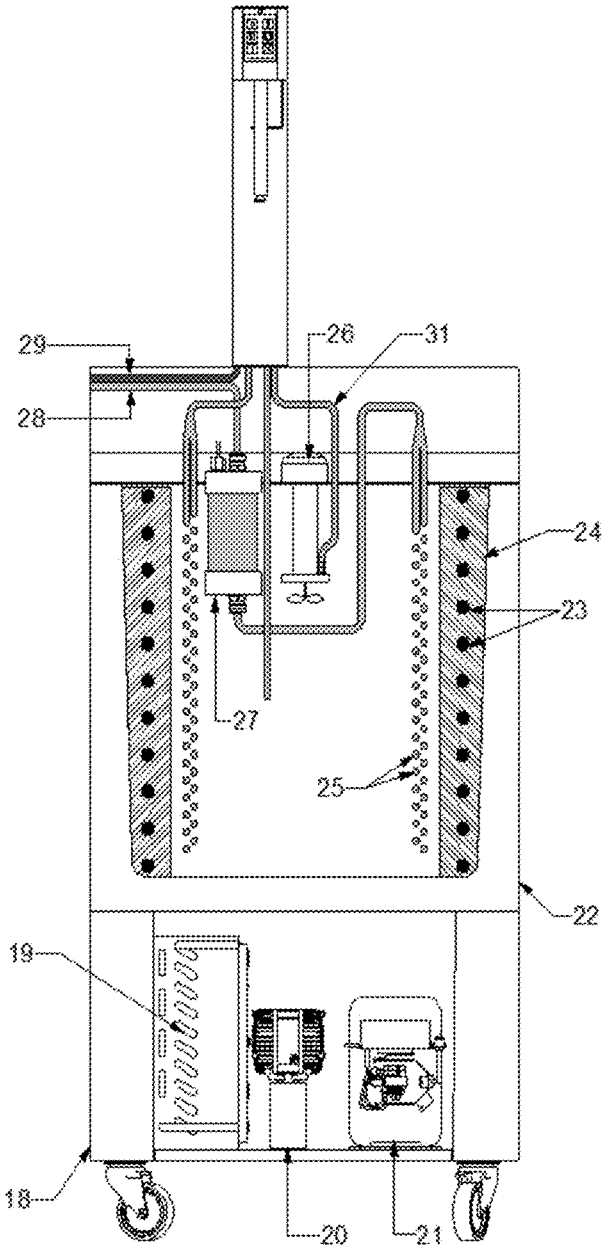
FIG. 5 illustrates an example of a portable liquid dispense system.

The liquid dispenser system may generally comprise a bottom fill, positive shut-off valve liquid dispenser. The system may comprise a nozzle (4) including a thermistor (2) to monitor the temperature of the liquid flowing into the nozzle in real time. The system may reduce and/or maintain the liquid's temperature to 5° C. (41° F.) or less when dispensed at high speeds, e.g., 6.5 L/min, from the nozzle (4). Without wishing to be bound to any particular theory, higher temperatures may generate foam and lead to a higher foam to liquid ratio in the cup. As shown in FIGS. 4 and 5, the system may comprise a recirculation line (31) filled with ice cold water or liquid glycol to reduce and/or maintain the liquid at a desirable dispense temperature. The recirculation line (31) may maintain the liquid's temperature after it has been chilled by the water tank (22). The recirculation line may be in thermal communication with the pipe (28) from the water tank (22) to the nozzle (4). The liquid dispenser system may have a flow rate of up to 6.5 L/min, such as 4 L/min to 6.5 L/min. For example, the liquid dispenser system may have a flow rate of up to 6.5 L/min for a beer having a carbon dioxide carbonation range of 2.2 to 2.7 volume $CO_2$/volume liquid at 20° C. at atmospheric pressure (e.g., 1 atm).

Figure 2:
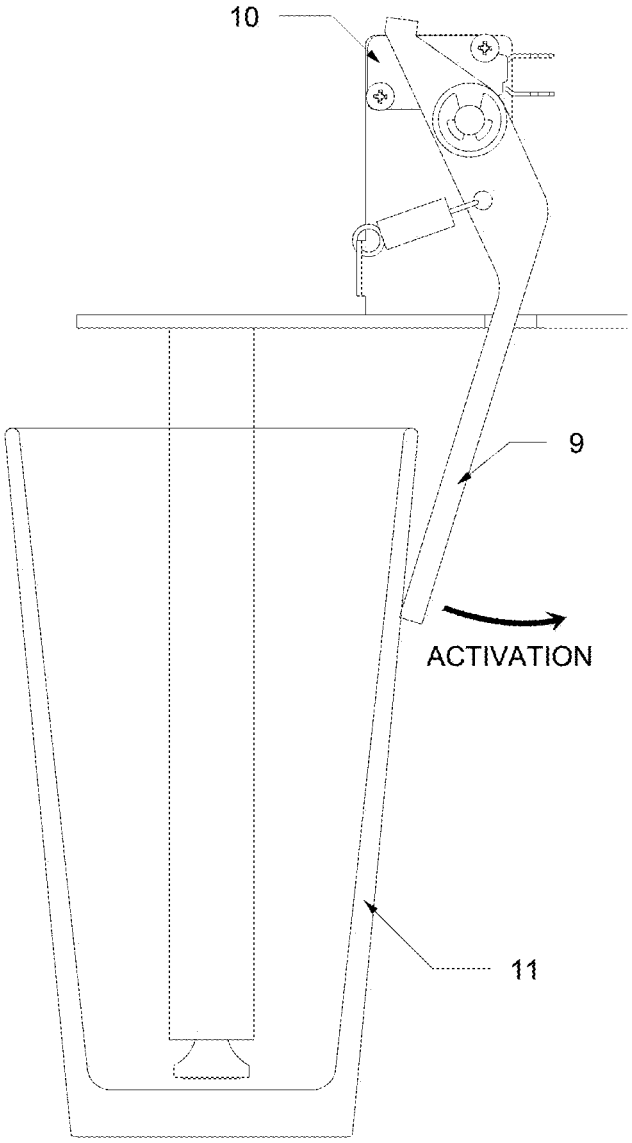
FIG. 2 illustrates an example of the activation of the liquid dispenser.

Referring to FIGS. 1 and 2, the liquid dispenser may be activated by placing a container (11) at the bottom of the nozzle (4) and pushing the container (11) toward a switch lever (9). The switch lever (9) may be configured to one-handed and/or two-handed operation. A user may manipulate the container (11) and switch lever (9) using a one- or two-hand operation. For example, a user may hold the container (11) using one hand and push the container (11) toward the switch lever (9) using the same hand. A pneumatic valve (8) may activate the cylinder (3) to open the beer flow by lowering the actuator rod (5) when the lever (9) is activated by pressing on a micro switch (10). A flowmeter (1) may count the number of pulses of the pneumatic valve (8). When the number of pulses matches the desired programmed quantity, a command to the pneumatic valve (8) may be sent to the cylinder (3) to stop the flow of beer by returning the actuator rod (5) and gasket on the rod tip (6) in an upward closed position.

The centering of the actuator rod (5) and therefore the gasket rod tip (6) may generate a symmetrical and laminar flow of the beer. The centered position of the actuator rod may be achieved by at least one, e.g., 1-8, 2-6, 2, 3, 4, 5, centering pins (7) press fitted within the actuator rod (5) perpendicular to one another. The distance between the centering pins (7) may be 1 mm to 20 mm, such as, e.g., 9 mm. A symmetrical and laminar flow of the fluid when dispensed from the dispenser minimizes and/or eliminates foaming, and therefore waste. An asymmetrical flow may create turbulence that releases gas in the fluid being dispensed. The released gas may generate foaming that contributes to waste. A generally constant cross-sectional area of the fluid flow within the nozzle (4) provides a generally constant velocity. A generally constant velocity may reduce and/or eliminate depressurization of the liquid being dispensed, and therefore waste.

Some types of beers, such as stouts or ales, for example, may be brewed with much less carbonation levels, but with added nitrogen. An example of a stout having added nitrogen is commercially available from GUINNESS. When beer with added nitrogen is dispensed, it may be desirable to release this nitrogen gas to provide a "cascade" effect that creates waves of nitrogen gas being released during dispensing to form a desirable "head" of foam on the beer. The "head" generated by the nitrogen may be light colored, creamy, and/or thick. In contrast, the foam generated by carbon dioxide during dispensing may be bubbly and wild, and undesirable.

Figure 3:
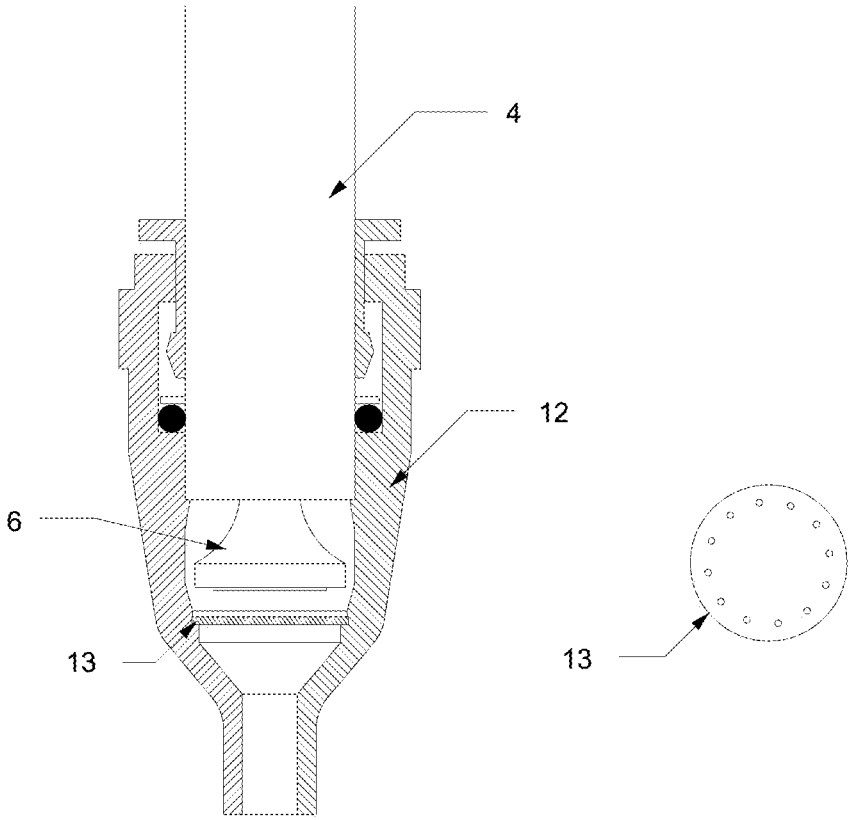
FIG. 3 illustrates an example of a nozzle including a creamer plate.

The liquid dispenser system may comprise a creamer plate. The creamer plate may comprise a restriction plate having small holes for the beer to flow through. Referring to FIG. 3, a creamer fitting (12) comprising a creamer plate (13) may be retrofitted to the nozzle (4) or may be integrated into the nozzle (not shown). The creamer fitting (12) comprises a tube push-in type fitting. When inserted at the bottom of the nozzle (4), the creamer fitting (12) may be removed by lowering the fitting's collar. The creamer fitting (12) may be removed daily to clean the creamer plate (13). The creamer plate (13) comprises a press fitted stainless steel plate including a plurality of holes, such as 12 holes, for example. The hole may have a diameter from 0.5 mm to 0.7 mm. The holes' diameter may relate to the type of beer and its gas content. For example, the liquid dispenser system may have a flow rate of 8 s/pint of stout with added nitrogen.

Figure 12:
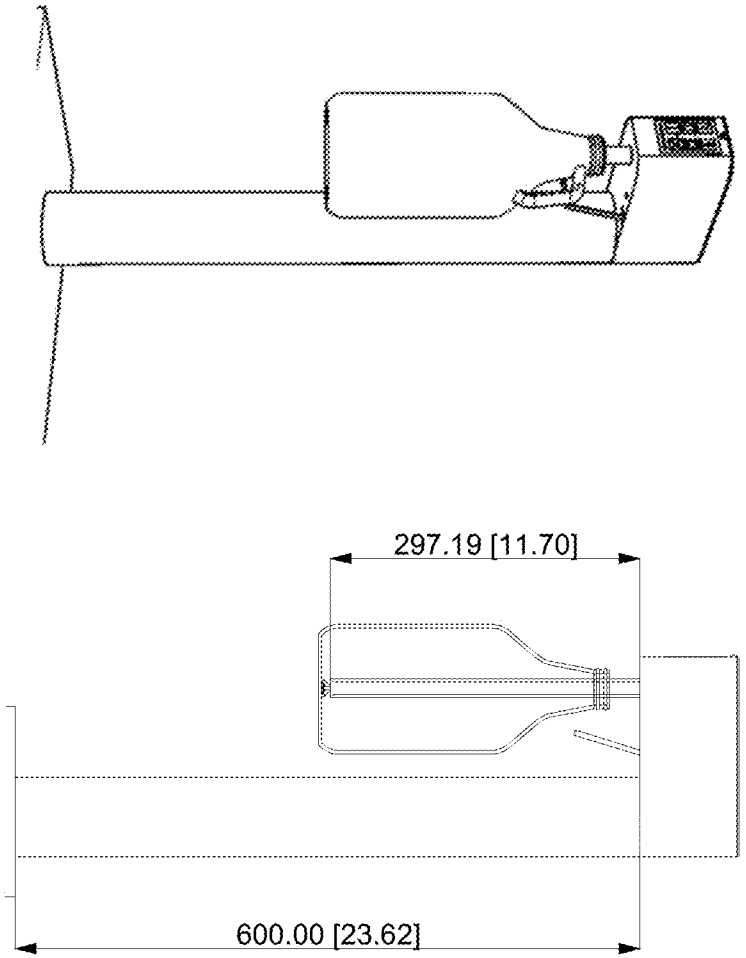
FIG. 12 illustrates an example of example of a liquid dispenser.

As shown in FIG. 12, the nozzle (4) may comprise a "Growler" nozzle. As generally used herein, a "Growler" refers to a 64 oz beer container that may be used for craft beers, for example. A conventional dispense system for a Growler may comprise counter pressure fillers in which the Growler is filled with carbon dioxide gas and pressurized. The beer line may be opened and pressure reduced to allow beer to enter the container from the top. However, conventional dispensing processes for a Growler may be slow, e.g., about 1 min per Growler, and/or operationally complicated. A dispense system comprising a "Growler" nozzle, as shown in FIG. 12, may be at least 12 inches long to allow the Growler to fit under it, and may fill the Growler in less than 1 minute, such as 25 seconds or less. Without wishing to be bound to any particular theory, this may be achieved by utilizing a positive shutoff valve at the bottom of the nozzle. In this manner the shock of the beer hitting the bottom of the Growler from a height of 11 inches, as seen in conventional Growler dispense systems, may be avoided. The beer may therefore flow right from the bottom of the nozzle valve at a higher rate with minimal or without the risk of excessive foaming. The volumetric portion control may also eliminate the time for one to measure the correct quantity to dispense (64 oz) which may further reduce dispense time.

Referring to FIG. 4, a liquid dispenser system may generally comprise a beverage container (14), a gas cylinder (15), a pressure regulator (16), a device to couple the beverage container to the gas cylinder (17), a condensing unit (18) comprising a condenser (19), a fan (20), a compressor (21), a water tank (22), an evaporator coil (23), an ice bank (24), beverage coils (25), an agitator pump (26), a foam on beer detector (27), a pipe (28) from the beverage container to the condensing foam on beer detector (27) in fluid communication with the beverage coils (25) to cool the beverage to a desired temperature, a pipe (29) from the gas cylinder to the liquid dispenser to the pneumatic valve (8), a pipe (30) from the gas cylinder (15) to the beverage container (14) to pressurize the beverage container (30), and a cold water recirculation line (31) to maintain the refrigeration temperature of the liquid after it has been refrigerated by the water tank (22) to the nozzle (4), a pressure sensor to measure the pressure of the beverage container (32), and a pressure sensor to measure the pressure of the gas (pneumatic) cylinder (33).

The system may comprise a pressure sensor to monitor the pneumatic pressure that drives the pneumatic valve in the nozzle (4). The pneumatic pressure may be at least 87 psig (6 bars) psi and up to 105 psig, to provide a short opening and closing time of the actuator rod, such as, for example, up to 0.5 seconds, up to 0.25 second, up to 0.1 seconds, from 0.05 to 0.5 seconds, 0.1 to 0.3 seconds, 0.1 to 0.2 seconds, 0.2 to 0.3 seconds, or 0.15 to 0.25 seconds. The source of the pressure may be a bottle of gas, e.g., nitrogen, carbon dioxide, or blends thereof, or an air compressor.

The system may comprise at least one pressure sensor to monitor the pressure applied to the beverage container. The source of the pressure may be a bottle of nitrogen gas, carbon dioxide, or blends thereof. The system may comprise a pressure sensor for Lager type beer and/or a pressure sensor for stout and/or ale type beers. For example, stout and Lager type beers could have independent gas sources to apply pressure to the respective beverage containers.

Referring to FIG. 5, a portable liquid dispenser system may generally comprise a beverage container (not shown), a gas cylinder (not shown), a pressure regulator (not shown), a device to couple the beverage container to the gas cylinder (not shown), a condensing unit (18) comprising a condenser (19), a fan (20), a compressor (21), a water tank (22), an evaporator coil (23), an ice bank (24), beverage coils (25), an agitator pump (26), a foam on beer detector (27), a pipe (28) from the beverage container to the condensing foam on beer detector (27) in fluid communication with the beverage coils (25) to cool the beverage to a desired temperature, a pipe (29) from the gas cylinder to the liquid dispenser to the pneumatic valve (8) a pipe (not shown) from the gas cylinder (15) to the beverage container (14) to pressurize the beverage container (30), and a cold water recirculation line (31) to maintain the refrigeration temperature of the liquid after it has been refrigerated by the water tank (22) to the nozzle (4).

Referring to FIG. 5, the portable liquid dispenser system may dispense a chilled beverage (i.e., at a temperature less than 20 to 26° C.) when the beverage container, e.g., a beer keg, is at a temperature of 20 to 26° C. or ambient temperature. The portable system may comprise a beer keg (14), a gas cylinder (15) filled with a dispensing gas, e.g., carbon dioxide, nitrogen, or beer mix. Carbon dioxide may be used for Lager or Pilsen type beers having carbonation levels between 2.2 volume $CO_2$/volume liquid to 2.7 volume $CO_2$/volume liquid. Nitrogen gas may be used for flat beverages lacking carbonation, such as wine, for example. The beer mix gas may comprise a blend of nitrogen and carbon dioxide at various ratios as a function of the type of beer and temperature of the liquid. The ratio may be varied based on the carbonation level of the beverage. Beer gas may be used for Stout type beers. A dual body pressure regulator (16) may supply gas to the beverage container (30) through first body and pneumatic pressure to the liquid dispenser (29) through the second body.

The beverage exiting the beverage container via the pipe (28) may have a fluid temperature of 20 to 26° C. or ambient temperature. The beverage may be chilled to a dispense temperature less than 20 to 26° C. or less than ambient temperature, such as 5° C.

A condensing unit (18) may comprise a condenser (19), a motor fan (20), and a compressor (21) connected to a water tank (22). The water in the water tank (22) may be chilled through an evaporator coil (23) to form an ice bank (24) around the evaporator coil (23). The volume of ice in the ice bank (24) may be up to ⅓ of the total water volume of the water tank (22).

Figure 6:
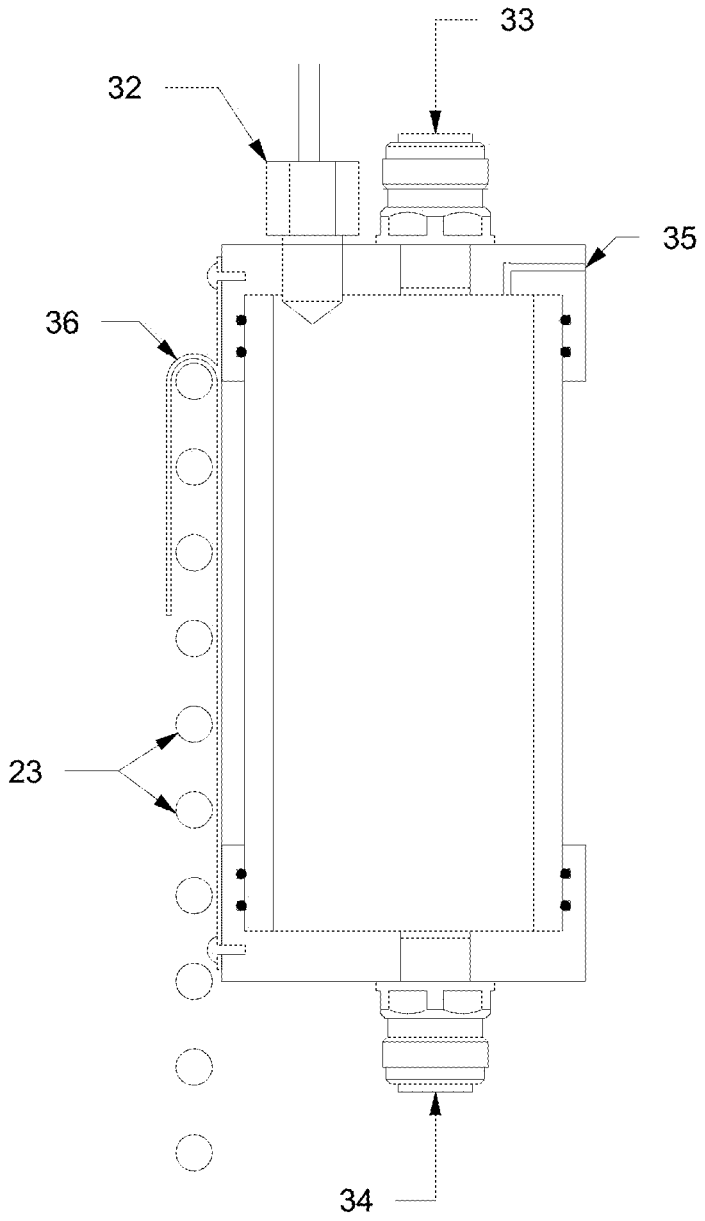
FIG. 6 illustrates an example of a foam on beer detector.

The beverage from the beverage container (14) enters the electronic foam on beer detector (27). Referring to FIG. 6, the detector (27) may reduce and/or eliminate gas from an empty keg (14) to reach the liquid dispenser and provide a generally continuous flow of beer with minimal or no waste that is normally generated between keg changes with conventional systems. The detector (27) may be submerged in the water tank (22) and coupled to the cooling coils (25). The detector (27) may be coupled to the cooling coils (25) via a bracket (36) that hooks onto the cooling coils (25). The detector (27) may be at least 50% submerged in the water tank (22), such as for example, at least 75%, at least 80%, at least 90%, and 80-90% submerged in the water tank (22). Submerging the detector (27) may pre-chill the beverage before the beverage enters the cooling coils (25). Pre-chilling the beverage may reduce and/or eliminate bacterial growth in the detector, which may occur in conventional systems. The detector (27) at room or ambient temperature may over heat and cause carbon dioxide to leave the beverage and create foaming at the tap when dispensed.

Figure 7:
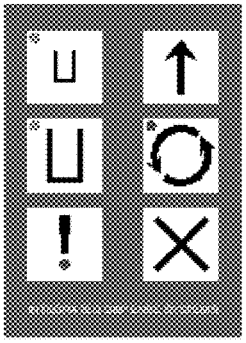
FIG. 7 illustrates an example of a keypad of the liquid dispenser system.

The detector (27) may comprise an inlet (33) to receive fluid from the beverage container (14) in fluid communication via a chamber with an outlet (34) in fluid communication with the liquid dispenser, a liquid sensor (32) to detect when gas enters the chamber, and an exhaust port (35) to exhaust the gas from the chamber. A signal may be sent to a control box (not shown) when gas is detected by the liquid sensor (32). The signal may trigger an alert e.g., a steady LED, which is displayed on the liquid dispenser's keypad as shown in FIG. 7. Dispensing the beverage may be interrupted by closing the dispense nozzle on the liquid dispenser. A new beverage container may be connected to the coupling device (17) and any excess gas in the detector (27) may be exhausted via a manual valve connected to the exhaust port (35). A signal may be sent to a control box (not shown) when liquid from the new beverage container is detected by the liquid sensor (32). The signal may trigger an alert, e.g., a blinking LED, which is displayed on the liquid dispenser's keypad as shown in FIG. 7. This alert may warn the bartender that a new beverage container has been connected and dispensing may be resumed. Dispensing may be resumed by pressing the beverage container change button on the keypad as shown in FIG. 7. After a short period of time, e.g., a few (1-30) seconds, the LED may turn off.

The beverage may exit the detector and enter at least one cooling coil (25). The cooling coil (25) may be metal, such as stainless steel. The cooling coil (25) may comprise two cooling coils in parallel. Each coil may have an 8 mm (5/16 inch) outside diameter and 20-30 meters length. The length may relate to the carbonation level of the beverage and ambient temperature. Without wishing to be bound to any particular theory, the length of the coil (25) in warmer climates is generally greater than the length of the coil (25) in cooler climates. For example, the length of the coil (25) near the equator may be 30 meters and the length of the coil (25) in temperate climates may be 20 meters. The cooling coils (25) arranged in parallel may reduce the pressure drop through the coils. Without wishing to be bound to any particular theory, improved (i.e., faster) dispensing speed at the desired dispense temperature may be achieved by reducing the pressure drop relative to conventional 1 coil systems. For example, a conventional 1 coil system including a stainless steel single coil having a 8 mm (5/16 inch) outside diameter and a length of 20 meters may reduce dispense speed to 3 L/min. The liquid dispenser may dispense at more than twice the average dispense speed of standard taps including a 1 coil system.

The refrigerated beverage may exit the cooling coils (25) and flow to the liquid dispenser. The refrigerated beverage may maintain its temperature at less than ambient temperature until it is dispensed via a cold water recirculation line (31). An agitator pump (26) placed inside the water tank (22) may recirculate water through the cold water recirculation line (31). The agitator pump (26) may recirculate water and agitate, e.g., stir, the water to improve the heat exchange between the warm beverage and the ice bank. In some instances, this may provide instant chilling of the beverage.

Referring to FIGS. 4 and 5, the beer cooler may comprise a horizontal arrangement of the condensing unit (18) and water tank (22) as shown in FIG. 4 or the beer cooler may comprise a vertical arrangement of the condensing unit (18) and water tank (22) as shown in FIG. 5. In the vertical arrangement, the condensing unit (18) may be under the water tank (22). A portable liquid dispenser system may comprise the vertical arrangement and caster wheels to provide mobility/portability.

A liquid dispenser system may generally comprise a liquid dispenser and a management system. The management system may include a computer. The computer may include an operating system, such as Linux.

Referring to FIG. 7, the liquid dispenser system may comprise a keypad. The keypad may be configured to allow the user to: (1) select a predetermined volume of liquid dispensed; (2) start dispensing liquid; (3) stop dispensing liquid; receive an alert when the beverage container is about empty; (4) receive an alert when a new beverage container is connected to the system; and (5) disable the system to prevent dispensing or enable the system to allow dispensing. The keypad may allow the user to select between programmable cup sizes, such as large and small cup sizes. The keypad may allow the user to manually dispense the beverage to top off the cup by dispensing liquid greater than the predetermined volume. For example, a user to manually dispense the beverage when a non-predetermined volume is needed to be dispensed or during cleaning operations to purge the beer line of the system. The keypad may allow the user to stop the liquid from being dispensed when, e.g., the wrong predetermined volume was selected. The stop button may be larger than the other inputs on the keypad.

The system may provide a visual alert to the user via at least one LED or blinking LED on the keypad. As shown in the Table below, the system may provide the following alerts:

| LED sequence | Alert |
|---|---|
| 1 blinking alarm LED | The temperature of the dispensed beverage is greater than a predetermined threshold temperature. |
| 2 blinking alarm LED | Flow fault. Nozzle is still open, but no pulses are being detected from the flow meter. Nozzle shuts closed. |
| 3 blinking alarm LED | The pressure of the beverage container is less than a predetermined threshold pressure. |
| Constant alarm LED (!) | The pressure of the liquid dispenser (pneumatic line) is less than a predetermined threshold pressure. |
| Constant alarm LED (!) and constant EMPTY LED | The beverage container is empty. |
| Constant alarm LED (!) and blinking EMPTY LED | The beverage container has been replaced with a new beverage container. The user may turn off this alert by pressing the EMPTY LED input to resume dispensing. |
| All LED's on | The system has been disabled. A user may enable the system by using the input to enter a passcode. |

The system may comprise a controller to control the system. The controller may be, for example, performing functions for the system, such as initialization, input/output (I/O), management, system reset functionality, deactivation, and to configure and control various devices within the system. The controller may be installed proximate to the liquid dispenser at a distance not greater than 7 feet. The dispense quantity may be measurable within 1% of the nominal volume. The controller may comprise: an on board computer; open source Linux operating system; Ethernet port; USB port with Wi-Fi dongle; up to 41 I/O ports; HDMI Video port; micro SD card slot; four-pole 3.5 mm jack with audio output and composite video output; 5 VDC; expansion board to expand to 80 I/O ports to drive up to 4 dispense points as shown in FIG. 5, for example; real time clock to set system time without internet connection; a plurality of pressure sensors; 12 VDC input; and/or 12 VDC output for LED brand illumination and LCD Video Screen power supply. The expansion board may allow the user to control the following hardware via the onboard computer: keypad (FIG. 4); pneumatic valve (8); flowmeter (1); thermistor (2); microswitch (10); end of keg sensor.

The empty keg sensor may be placed along the pipe (28) to detect the presence of gas within the pipe (28). The empty keg sensor may detect gas within the pipe (28) when the beverage container (14) is empty. The empty keg sensor may comprise a float level type sensor or an optical level sensor (32). The empty keg sensor may reduce or eliminate gas from reaching the nozzle. The liquid dispenser may stop dispensing when the empty keg sensor detects gas within the pipe (28).

The system may comprise NFC/RFID controller shield to activate the system via NFC smart cards inserted in a slot. The system may record the identity of the person dispensing the beverage for each dispense event. This feature may be useful for management and/or theft or waster prevention.

The system may be configured to allow customers to use pre-paid NFC cards to authorize a dispense event. The system may check the presence of prepaid money within the NFC card and enable the system when sufficient money is present. When the pour is complete, the dollar amount may be subtracted from the NFC smart card. Once empty, the NFC smart card may be recharged with money at charging stations.

The system may comprise an LCD monitor connected to the HDMI port of the onboard computer. The monitor may be programmed to show a video. The video file may be stored inside the computer's SD memory card. The onboard computer may, on a regular basis, connect to an external FTP server and check the presence of a new video when the system is connected to the internet via the Ethernet port or Wi-Fi dongle. The computer may download the new video and replace the old video when a new video is present. The new video may be shown as soon as the download is complete. The FTP server may be managed by the beer brand owner and/or bar restaurant chain owner to transmit marketing content and modify the video as they see fit without having to physically go to the liquid dispenser and manually upload the video. The monitor may broadcast live qualitative information about the dispense event that just occurred, e.g., beer temperature, quantity and system pressures, directly to the customer to indicate the quality of the beer just served.

The onboard computer may process the hardware information and transmit a webserver within an intranet network through its Ethernet ports or Wi-Fi dongle. An onboard database may store the data. The webserver may be called S-Tap-Manager. The webserver may be accessible via a LAN connection to the control box (Ethernet or Wi-Fi). The webserver may be visible with any smart device capable of browsing. Should an Ethernet or Wifi network not be available within the facility where the unit is installed, it is possible for the on board computer to generate its own Wifi Hotspot that allows any device equipped with Wifi capability to connect to it. The SSID of the Hot Spot may be shown as the serial number of the unit. The onboard computer may also be equipped with BLUETOOTH capability. A specific mobile app may be developed to interface and manage with S-Tap to replace the Webserver should the BLUETOOTH communication be required. The BLUETOOTH capability along with Ethernet may allow the onboard computer to communicate with a POS (Point of Sale) system and supply live information about which product was dispensed and corresponding amount.

The webserver may allow user to: (1) set login credentials; (2) select standard unit of measure utilized by the system; (3) set the hardware clock time when system is not connected to the internet; (4) set Wi-Fi connection to local area network; (5) select between scanned networks and input network password; (6) set the specific beer names for each nozzle; (7) set keg type for keg yield calculations either manually or from a drop down list of industry standard kegs; (8) associate pressure monitor(s) to specific beer types; (9) select up to two predetermined volume amounts per nozzle selectable via the keypad; (10) set weekly opening and closing hours when the system is enabled and disabled, respectively; (11) set minimum pneumatic tower pressure; (12) set minimum beer pressure; and/or (13) set maximum beer temperature.

A plurality of liquid dispensing systems may be connected to each other via the webserver. The webserver may comprise a CMS (Centralized Management Server). The webserver may be installed in the same network as the controller. The CMS may collect any alarms and/or warning from each controller and present this information live on at least one screen. The CMS may be a computer driven by a Linux operating system. Each controller may be assigned a Nameserver on the network. The Nameserver may be associated with a section or location of the stadium/venue. Each alarm and/or warning may be identified with the location (Nameserver) of the controller and the beer/beverage name. The CMS may receive information from each controller, either continuously or intermittently after a set period of time. The period of time may be, for example, 1-30 minutes, 1-5 minutes or 1 minute. The CMS may provide information for two or more of the plurality of liquid dispensing systems.

As shown in FIG. 14, the CMS may receive information from each controller at least every minute and display on screen the following alarms: (1) a proximity to keg exhaustion alarm that may be set from 90-95% nominal value; (2) a low keg pressure alarm that may monitor when the gas supply to the cold room can be replaced; (3) a low pneumatic pressure alarm that may monitor when gas supply to liquid dispensing system may be replaced; (4) a high beer temperature alarm that may be set to any temperature, e.g., 42° F.; and/or (5) a flow meter malfunction alarm. One or more users may access the CMS and manage in real time alarms and/or warnings. The system may comprise a query page to allow the user to view the historical data of alarms and/or warnings from previous events and/or by Nameserver.

The standard unit of measure utilized by the system may be selected from the following list:

| Units | Pressure | Temperature | Volume |
|---|---|---|---|
| Metric | Bar | ° C. | Liter |
| Imperial/ UK | Psi | ° C. | Pint |
| U.S. | Psi | ° F. | Ounce |

When the weekly opening and closing hours are set, the user may be alerted to dispense events outside of the set hours, or enable the system to dispense only during opening hours.

When the minimum pneumatic tower pressure is set, the system may immediately stop fluid flow when the pneumatic tower pressure falls below the set value. The pneumatic tower pressure may fall below the set value when the source of the pneumatic gas is empty in the case of a gas bottle or the source of the pneumatic gas is malfunctioning in the case of an air compressor.

When the minimum beer pressure is set, the system may immediately stop fluid flow when the pressure supplying gas to the beverage container, e.g., keg, falls below set value. The minimum beer pressure may fall below the set value when the source of the beer gas is empty in the case of a gas bottle.

A thermistor (2) may measure the beer temperature at the nozzle (4) when the beverage is dispensed. The beer temperature may be an average temperature of the dispense event. A LED alarm on the keypad may be activated when the beer temperature is above the set maximum temperature.

Real time data of the system may be viewed through the webserver. The webserver may include a query page to allow the user to select a time range and all or one specific beer. The following information may be displayed on a screen to the user is illustrated in the table below:

| Title | Information |
|---|---|
| Beer | Beer name of dispense event. |
| Time | Time of dispense. Cell will be red if time is outside of set opening times. |
| Quantity | Quantity dispensed |
| Flow rate | Flow rate of dispensed beer. A fluctuating value may indicate issues with beer pressure supply. |
| Daily Quantity | Cumulative dispensed quantity for date shown. |
| Keg yield % | Percentage of consumed keg. As percentage increase so does the intensity of color of the cell. |
| Temperature | Dispensed temperature. Cell will be red if temperature is higher than max set Temperature. |
| Tower Pressure | Pneumatic pressure driving tower. Cell will be red if pressure is lower than set tower pressure. |
| Beer Pressure | Beer pressure. Normally primary ring pressure. Cell will be red if pressure is lower than set beer pressure |
| Notice | Top off (use of Top Off button to dispense)<br>Line cleaning |
| Warning | End of keg<br>Flow fault |

The information may be downloaded to a user's device in a spreadsheet or may be uploaded to a remote FTP server as a security backup should the internal database fail. The information on the internal database is backed-up daily.

Figure 13:
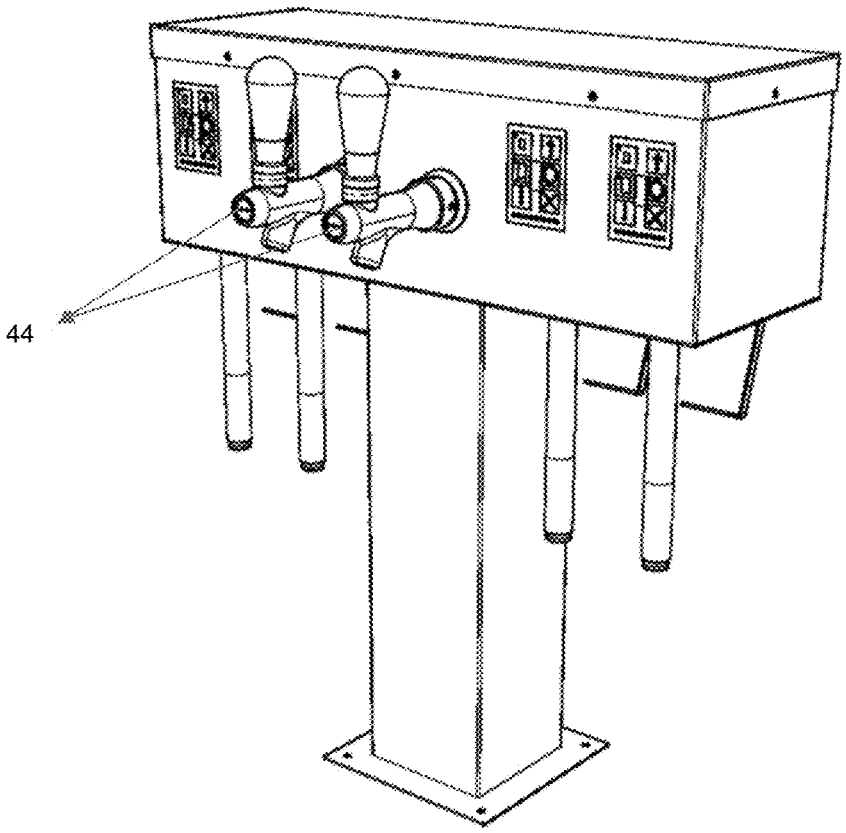
FIG. 13 illustrates an example of example of a liquid dispenser.

The Referring to FIG. 13, a fluid dispenser may generally comprise at least one conventional nozzle (44) and a least one nozzle (4) comprising an inlet in fluid communication with an outlet to form a flow path; a thermistor (2) proximate to the inlet; an actuator rod (5) comprising a gasket rod tip viton (6); at least one centering pin (7) to center the actuator rod (5) in at least a portion of the flow path at the first outlet; and a double acting pneumatic cylinder (3) comprising a first pneumatic inlet and a second pneumatic inlet; wherein the nozzle (4) and/or actuator rod (5) opens to dispense fluid when gas enters the first pneumatic inlet of the cylinder (3) and closes when gas enters the second pneumatic inlet of the cylinder (3). The fluid dispenser may comprise a flowmeter (not shown) in fluid communication with the nozzle's inlet. The fluid may comprise a liquid, such as beer, for example. As shown in FIG. 13, a tower may comprise two standard nozzles (44) and four nozzles (4). The standard nozzles (44) may be used for higher cost and/or lower turnover beers, and nozzles (4) may be used for high turnover beers. The tower may comprise various shapes and different numbers of standard nozzles (44) and nozzles (4). The tower may also dispense other liquids, such as beer, wine, hard ciders, soft drinks, chilled coffee, iced teas, for example.

The general architecture of the system may include at least a central processing unit (CPU) where the computer instructions that comprise the software application are processed; a display interface or a keyboard interface that provides a communication interface to the device; a network connection interface that provides a communication interface to a network; a random access memory (RAM) where computer instructions and data are stored in a volatile memory device for processing by the CPU; a read-only memory (ROM) where invariant low-level systems code or data for basic system functions such as basic input and output (I/O), startup, or reception of input information are stored in a non-volatile memory device; a storage medium or other suitable type of memory (e.g. such as RAM, ROM, programmable read-only memory (PROM), erasable programmable read-only memory (EPROM), electrically erasable programmable read-only memory (EEPROM), magnetic disks, optical disks, floppy disks, hard disks, removable cartridges, flash drives), where the files that comprise an operating system, application programs (including, for example, a web browser application, a widget or gadget engine, and or other applications, as necessary) and data files are stored; a navigation module that provides a real-world or relative position or geographic location of the system; a power source that provides an appropriate alternating current (AC) or direct current (DC) to power components.

As used in this specification and in the appended claims, the term "network" is meant to be understood broadly as any connection between at least two components such that the components are able to communicate with each other, including at least electrical communication and/or wireless communication. In the embodiments described herein, the term "Internet" is used generally to refer to a worldwide collection of networks and gateways that utilize the Transmission Control Protocol/Internet Protocol (TCP/IP) suite of protocols to communicate with one another. Of course, network access may also be provided via a number of different types of networks, such as an intranet, a local area network (LAN), a virtual private network (VPN), or other wide area network (WAN) other than the Internet, for example.

Each of the characteristics and examples described above, and combinations thereof, may be said to be encompassed by the present invention. The present invention is thus drawn to at least the following non-limiting aspects:

(1) a liquid dispenser comprising: a nozzle comprising an inlet in fluid communication with an outlet to form a flow path; a thermistor in fluid communication with the inlet; an actuator rod comprising a gasket rod tip viton; at least one centering pin to center the actuator rod in at least a portion of the flow path; a flowmeter in fluid communication with the inlet; a double acting pneumatic cylinder comprising a first pneumatic inlet and a second pneumatic inlet operatively connected to the actuator rod; and a switch lever operatively coupled to a micro switch, wherein the nozzle opens when gas enters the first pneumatic inlet when the switch lever is activated by pressing on the micro switch and closes when gas enters the second pneumatic inlet when the switch lever is deactivated;

(2) the liquid dispenser of aspect 1 comprising a bottom fill, positive shut-off valve liquid dispenser;

(3) the liquid dispenser of aspects 1 or 2 comprising a flow rate from 4 L/min to 6.5 L/min;

(4) the liquid dispenser of any of aspects 1-3 comprising: a creamer fitting coupled to the nozzle, wherein the creamer fitting comprises a tube push-in type fitting; and a creamer plate comprising a plurality of apertures having a diameter from 0.5 mm to 0.7 mm;

(5) the liquid dispenser of any of aspects 1-4, wherein the nozzle comprises a Growler nozzle having a length of at least 30 cm;

(6) a liquid dispensing system comprising: the liquid dispenser of any of aspects 1-5 in fluid communication with a beverage container comprising a liquid to be dispensed; a gas source coupled to the beverage container to pressurize the beverage container; a condensing unit comprising a condenser, a fan, and a compressor; and a water tank comprising an evaporator coil, an ice bank, at least one beverage coil, and an agitator pump; wherein the beverage coil is in fluid communication with the liquid dispenser;

(7) the system of aspect 6, wherein the gas source comprises a gas cylinder of pressurized gas and a pressure regulator, an air compressor, a pressure cartridge filled with pressurized gas, a solid substrate with gas molecules adsorbed on the surface thereof, or any combination thereof;

(8) the system of aspect 6 or 7 comprising an electric foam on beer detector in fluid communication with the liquid dispenser and the beverage container, wherein dispensing of the beverage is shutoff when the beverage is not contacting the electric foam on beer detector;

(9) the system of any of aspects 6-8, wherein the electric foam on beer detector comprises: an inlet in fluid communication with an outlet; a chamber in fluid communication with the inlet and the outlet to receive the beverage from the beverage container; an electronic liquid sensor to detect the beverage in the chamber; and an exhaust port to exhaust any gas in the chamber;

(10) the system of any of aspects 6-9 comprising a processor to control the pneumatic valve, flowmeter, thermistor, microswitch, and liquid sensor;

(11) the system of aspect 10 comprising at least one network interface to transmit signals over a communication network, wherein the interface is in electrical communication with the processor;

(12) the system of aspects of 6-11 comprising a wireless communication interface including at least one of BLUETOOTH communication, a radio-frequency identification (RFID) communication, a near-field communication (NFC), or a personal area network (PAN) communication to connect to a WiFi or Ethernet communications network or machine-to-machine (M2M) wireless communications network;

(13) the system of any of aspects 6-12 comprising a mobile hotspot interface;

(14) the system of any of aspects 6-13 comprising at least one conventional liquid dispenser;

(15) the system of any of aspects 6-14 comprising a display to output at least one of audio and visual outputs;

(16) the system any of aspects 10-15 comprising a beverage container, a gas cylinder, a pressure regulator, a device to couple the beverage container to the gas cylinder, a condensing unit comprising a condenser, a fan, a compressor, a water tank comprising, an evaporator coil, an ice bank, at least one beverage coil, and an agitator pump, a foam on beer detector, and the liquid dispenser of any of aspects 1-5; wherein the beverage container is in fluid communication with the liquid dispenser; wherein the beverage container is in fluid communication the foam on beer detector; wherein the foam on beer detector is in fluid communication with the beverage coil; wherein the beverage coil is in fluid communication with the liquid dispenser; wherein the gas cylinder is in fluid communication with the beverage container; wherein the gas cylinder is in fluid communication with the liquid dispenser; wherein the agitator pump is in fluid communication with the water tank via a cold water recirculation line;

(17) the system any of aspects 10-15 comprising a portable liquid dispensing system comprising a beverage container, a gas cylinder, a pressure regulator, a device to couple the beverage container to the gas cylinder, a condensing unit comprising a condenser, a fan, a compressor, a water tank comprising, an evaporator coil, an ice bank, at least one beverage coil, and an agitator pump, a foam on beer detector, and the liquid dispenser of any of aspects 1-5; wherein the beverage container is in fluid communication with the liquid dispenser; wherein the beverage container is in fluid communication the foam on beer detector; wherein the foam on beer detector is in fluid communication with the beverage coil; wherein the beverage coil is in fluid communication with the liquid dispenser; wherein the gas cylinder is in fluid communication with the beverage container; wherein the gas cylinder is in fluid communication with the liquid dispenser; wherein the agitator pump is in fluid communication with the water tank via a cold water recirculation line; and wherein the condensing unit and water tank comprise a vertical arrangement; and

(18) the system any of aspects 10-15 comprising a hybrid liquid dispensing system comprising a beverage container, a gas cylinder, a pressure regulator, a device to couple the beverage container to the gas cylinder, a condensing unit comprising a condenser, a fan, a compressor, a water tank comprising, an evaporator coil, an ice bank, at least one beverage coil, and an agitator pump, a foam on beer detector, and the liquid dispenser of any of aspects 1-5 and a conventional liquid dispenser; wherein the beverage container is in fluid communication with the liquid dispenser; wherein the beverage container is in fluid communication the foam on beer detector; wherein the foam on beer detector is in fluid communication with the beverage coil; wherein the beverage coil is in fluid communication with the liquid dispenser; wherein the gas cylinder is in fluid communication with the beverage container; wherein the gas cylinder is in fluid communication with the liquid dispenser; wherein the agitator pump is in fluid communication with the water tank via a cold water recirculation line.

All documents cited herein are incorporated herein by reference, but only to the extent that the incorporated material does not conflict with existing definitions, statements, or other documents set forth herein. To the extent that any meaning or definition of a term in this document conflicts with any meaning or definition of the same term in a document incorporated by reference, the meaning or definition assigned to that term in this document shall govern. The citation of any document is not to be construed as an admission that it is prior art with respect to this application.

While particular embodiments have been illustrated and described, it would be obvious to those skilled in the art that various other changes and modifications can be made without departing from the spirit and scope of the invention. Those skilled in the art will recognize, or be able to ascertain using no more than routine experimentation, numerous equivalents to the specific apparatuses and methods described herein, including alternatives, variants, additions, deletions, modifications and substitutions. This application including the appended claims is therefore intended to cover all such changes and modifications that are within the scope of this application.

What is claimed is:

1. A beer dispensing system comprising:

a beer dispenser in fluid communication with a beverage container comprising a beer to be dispensed, the beer dispenser including a nozzle comprising an inlet in fluid communication with an outlet to form a flow path, a thermistor in fluid communication with and proximate to the inlet, an actuator rod comprising a gasket rod tip viton, and at least one centering pin to center the actuator rod in at least a portion of the flow path, a flowmeter in fluid communication with the inlet, a double acting pneumatic cylinder comprising a first pneumatic inlet and a second pneumatic inlet operatively connected to the actuator rod, and a lateral switch lever operatively coupled to a micro switch for one-hand activation of the switch lever, wherein the nozzle opens when gas enters the first pneumatic inlet when the switch lever is activated by pressing laterally on the micro switch and closes when gas enters the second pneumatic inlet when the switch lever is deactivated, and wherein the inlet is oriented at an angle of 90 degrees with respect to the outlet;

a gas source coupled to the beverage container to pressurize the beverage container;

a first pressure sensor to measure the pressure of the beverage container;

a second pressure sensor to measure the pressure of the double acting pneumatic cylinder;

a condensing unit comprising a condenser, a fan, and a compressor; and a water tank comprising an evaporator coil, an ice bank, at least one beverage coil, and an agitator pump;

wherein the beverage coil is in fluid communication with the beer dispenser.

2. The system of claim 1, wherein the beer dispenser comprises a bottom fill, positive shut-off valve beer dispenser.

3. The system of claim 1, wherein the beer dispenser comprises a flow rate from 4 L/min to 6.5 L/min.

4. The system of claim 1, wherein the beer dispenser comprises:

a creamer fitting coupled to the nozzle, wherein the creamer fitting comprises a tube push-in type fitting; and a creamer plate for nitrogenated beer comprising a plurality of apertures having a diameter from 0.5 mm to 0.7 mm to release gas from the beer.

5. The system of claim 1, wherein the nozzle comprises a nozzle having a length of at least 30 cm and the beer dispenser has a flow rate of at least 64 oz/25 seconds.

6. The system of claim 1, wherein the gas source comprises a gas cylinder of pressurized gas and a pressure regulator, an air compressor, a pressure cartridge filled with pressurized gas, a solid substrate with gas molecules adsorbed on the surface thereof, or any combination thereof.

7. The system of claim 1 comprising an electric foam on beer detector in the ice bank and in fluid communication with the beer dispenser and the beverage container, wherein dispensing of the beer is shutoff when the beer is not contacting the electric foam on beer detector.

8. The system of claim 7, wherein the electronic foam on beer detector comprises:

an inlet in fluid communication with an outlet;

a chamber in fluid communication with the inlet and the outlet to receive the beer from the beverage container;

an electronic beer sensor to detect the beverage in the chamber; and an exhaust port to exhaust any gas in the chamber.

9. The system of claim 1 comprising a processor to control the double acting pneumatic cylinder, the flowmeter, the thermistor, the first pressure sensor, the second pressure sensor, the micro switch, and the electronic beer sensor.

10. The system of claim 9 comprising at least one network interface to transmit signals over a communication network to control the double acting pneumatic cylinder, the flowmeter, the thermistor, the first pressure sensor, the second pressure sensor, the micro switch, and the electronic beer sensor, wherein the interface is in electrical communication with the processor.

11. The system of claim 9 comprising a wireless communication interface to communicate with the processor, wherein the wireless communication interface includes at least one of radio communication, a radio-frequency identification (RFID) communication, a near-field communication (NFC), or a local area network (LAN) communication to connect to a WiFi or Ethernet communications network or machine-to-machine (M2M) wireless communications network.

12. The system of claim 9 comprising a mobile hotspot interface to the transmit signals over a communication network.

13. The system of claim 1 comprising a display to output marketing content comprising audio and visual outputs.

14. The system of claim 1, wherein the nozzle closes when a programmed amount of beer flows through the flowmeter.

15. A beer dispenser comprising:

a nozzle comprising an inlet in fluid communication with an outlet to form a flow path;

a thermistor in fluid communication with and proximate to the inlet;

an actuator rod comprising a gasket rod tip viton;

at least one centering pin to center the actuator rod in at least a portion of the flow path;

a flowmeter in fluid communication with the inlet;

a double acting pneumatic cylinder comprising a first pneumatic inlet and a second pneumatic inlet operatively connected to the actuator rod;

a lateral switch lever operatively coupled to a micro switch for one-hand activation of the switch lever;

a first pressure sensor to measure the pressure of a beer to be dispensed;

a second pressure sensor to measure the pressure of the double acting pneumatic cylinder;

a processor to control the pneumatic cylinder, the flowmeter, the thermistor, the first pressure sensor, the second pressure sensor, and the micro switch; and a wireless communication interface to communicate with the processor, wherein the wireless communication interface includes at least one of radio communication, a radio-frequency identification (RFID) communication, a near-field communication (NFC), or a local area network (LAN) communication to connect to a WiFi or Ethernet communications network or machine-to-machine (M2M) wireless communications network;

wherein the nozzle opens when gas enters the first pneumatic inlet when the switch lever is activated by pressing laterally on the micro switch and closes when gas enters the second pneumatic inlet when the switch lever is deactivated; and wherein the inlet is oriented at an angle of 90 degrees with respect to the outlet.

16. The beer dispenser of claim 15, wherein the beer dispenser comprises a bottom fill, positive shut-off valve beer dispenser.

17. The beer dispenser of claim 15 comprising a flow rate from 4 L/min to 6.5 L/min.

18. The beer dispenser of claim 15 comprising:

a creamer fitting coupled to the nozzle, wherein the creamer fitting comprises a tube push-in type fitting; and a creamer plate for nitrogenated beer comprising a plurality of apertures having a diameter from 0.5 mm to 0.7 mm to release gas from the beer.

19. The beer dispenser of claim 15, wherein the nozzle comprises a nozzle having a length of at least 30 cm and the beer dispenser has a flow rate of at least 64 oz/25 seconds.

20. The beer dispenser of claim 15, wherein the nozzle closes when a programmed amount of beer flows through the flowmeter.

* * * * *